US005507673A

United States Patent [19]

Boggia

[11] Patent Number: 5,507,673

[45] Date of Patent: Apr. 16, 1996

[54] JET PROPELLED WATERCRAFT

[76] Inventor: Richard Boggia, 431 Post Rd. East, Westport, Conn. 06880

[21] Appl. No.: 453,677

[22] Filed: May 30, 1995

[51] Int. Cl.[6] ..... B63H 11/01

[52] U.S. Cl. ..... 440/46; 440/88

[58] Field of Search ..... 440/38, 39, 40, 440/46, 47, 48, 88; 60/221, 222; 165/41, 44

[56] References Cited

U.S. PATENT DOCUMENTS

| | | | |
|---|---|---|---|
| 2,415,154 | 2/1947 | Walter | 440/88 |
| 3,292,373 | 12/1966 | Tado | 440/88 |
| 3,809,492 | 5/1974 | Takaeda | 440/46 |
| 4,557,319 | 12/1985 | Arnold | 440/88 |
| 5,330,374 | 7/1994 | Ishino | 440/38 |

*Primary Examiner*—Stephen Avila
*Attorney, Agent, or Firm*—Edward R. Hyde

[57] ABSTRACT

A jet propelled watercraft propelled using an internal combustion engine. The water providing the jet is drawn past a cooling device to cool the engine cooling liquid.

4 Claims, 2 Drawing Sheets

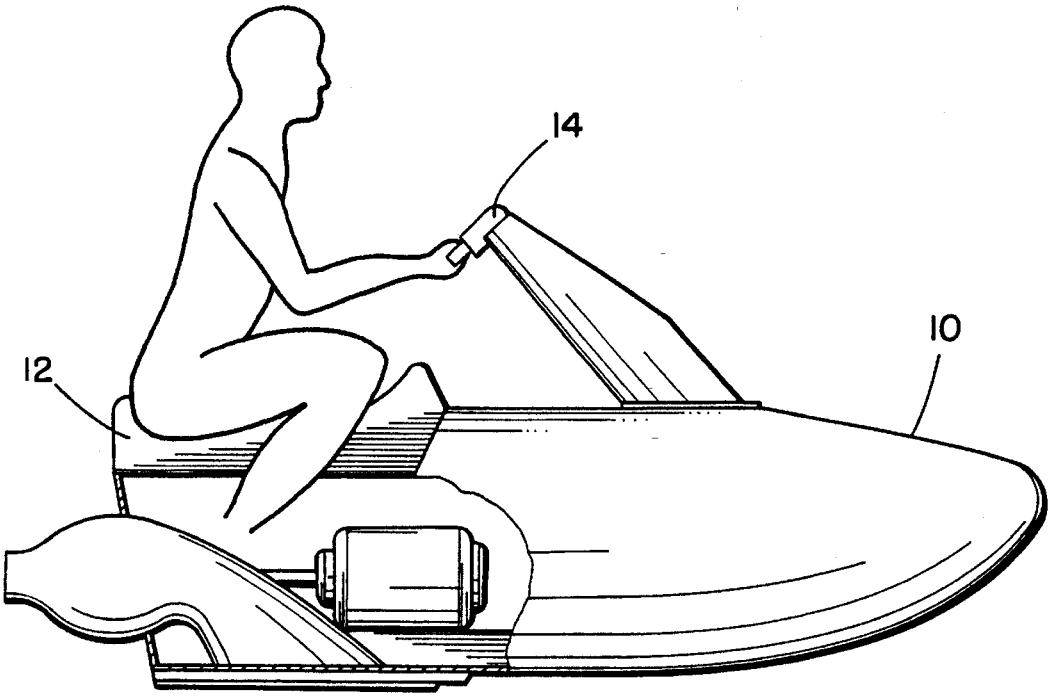
FIG. 2.
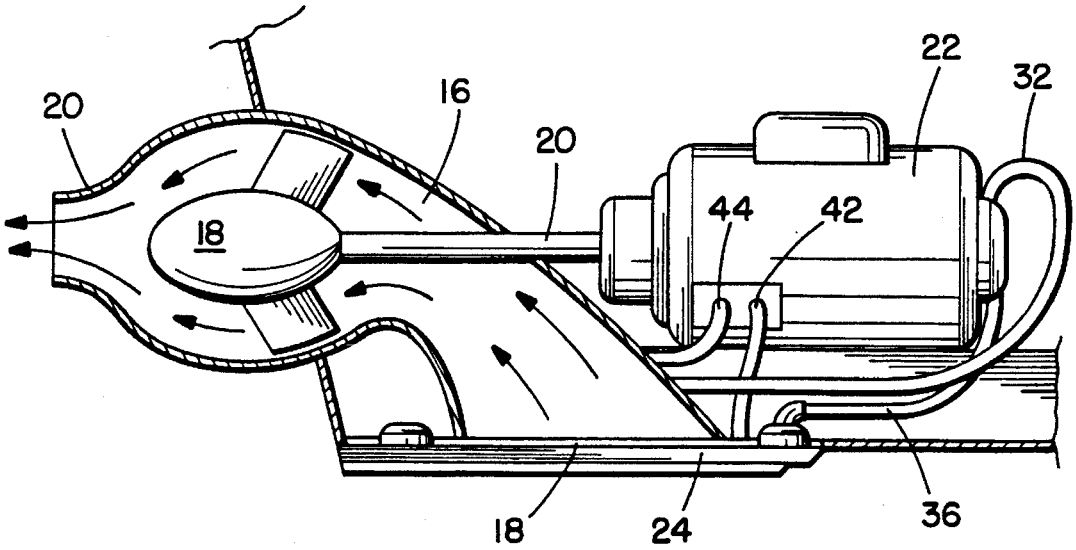

JET PROPELLED WATERCRAFT

BACKGROUND OF THE INVENTION

1. Field of the Invention

The present invention relates to jet propelled watercraft of the type that generally has a single operator controlling the craft which is propelled by an internal combustion engine having an impeller system for providing a water jet to propel the craft through the water.

These watercrafts are conventionally highly maneuverable, fast, and operate in various bodies of water. The internal combustion engine that drives the watercraft is customarily water cooled and the present invention is directed to an improved water cooling system.

2. Description of the Prior Art

Watercraft of the present type are conventionally driven by internal combustion or diesel engines that are water cooled and the sea water within which the boat is operating is often used to cool the engine. Alternatively, some engines have a sealed fresh water cooling system which in turn is cooled by the sea water employing a heat exchanging unit.

U.S. Pat. No. 5,330,374 discloses a jet boat driving system where sea water is used to propel the boat and also to cool the fresh water cooling system of the engine. U.S. Pat. Nos. 4,552,537 and 3,785,327 show the use of sea water as a coolent as well as the jet propellent of the watercraft. A prior patent that teaches the use of water cooling to cool the oil of a jet boat is U.S. Pat. No. 3,990,424.

SUMMARY OF THE INVENTION

As pointed out above it is conventional for jet propelled watercraft to utilize water cooled engines. Further, it is conventional to have a grating or screening device at the propulsion duct opening through which water is drawn and expelled through a discharge nozzel for propulsion of the watercraft. The purpose of the grating is to prevent foreign objects such as stones, shells, etc. from being drawn through the propulsion system. The grating effectively screens out foreign articles and prevents them from being drawn into the watercraft.

The present invention contemplates utilizing the grating for cooling the engine cooling liquid. Thus the engine will have a water jacket that connects to the input grating which in turn has hollow tubes through which the engine coolant flows. In this manner the sea water passing through the grating serves to cool the engine coolant.

Against the foregoing background it is a primary object of the present invention to provide an engine cooling system in which sea water is employed to cool the engine coolant fluid.

It is a further object of the present invention to provide a cooling system in which the input screening device of a jet propulsion unit is employed to cool an engine coolant fluid.

It is a further object of the present invention to provide a jet propulsion craft in which the propulsion water drawn into the craft passes an input grating that in turn is a portion of an internal combustion engine cooling system.

BRIEF DESCRIPTION OF THE DRAWINGS

The foregoing and still other objects and advantages of the present invention will be more apparent from the following detailed explanation of the preferred embodiments of the invention considered in connection with the accompanying drawings herein in which:

FIG. 1 is a schematic view of a small jet propelled watercraft with a rider thereon;

FIG. 2 is a side view partially broken away of the propulsion system of the watercraft;

DETAILED DESCRIPTION OF A PREFERRED EMBODIMENT

Figure 3:
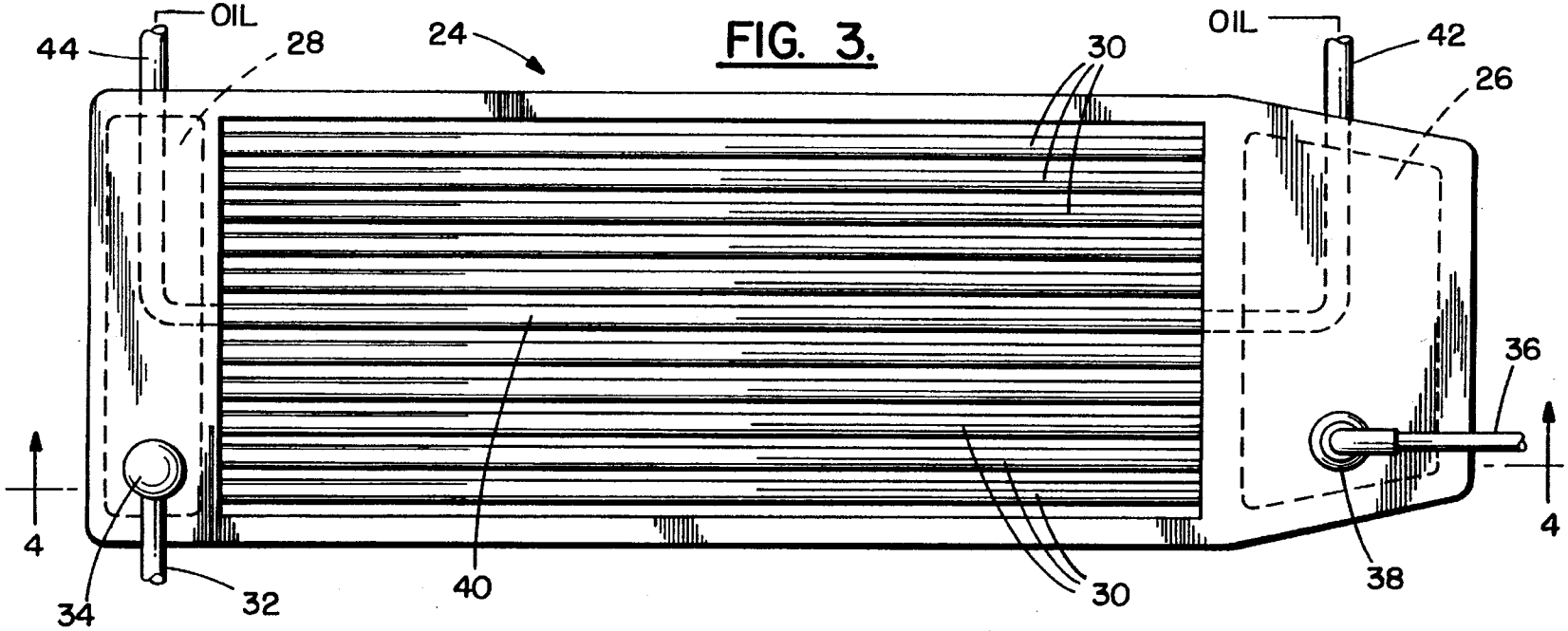
FIG. 3 is a plan view of a grating of the present invention.

Referring now to FIG. 1, 10 indicates the hull of a small watercraft of the type that would employ the present invention. The hull may be formed of any suitable material as molded fiberglass and as illustrated is operated by a single rider seated in a manner straddling a seat 12 and having his legs extending down into the hull of the watercraft. A suitable steering mechanism (not shown) is controlled by the operator through a handle bar assembly 14 that through appropriate connections will control the steering and hence the direction of the watercraft.

Propulsion is provided by a known system more clearly shown in FIG. 2 and comprising a water duct 16 that connects to an input opening 18 in the bottom of the hull. This permits water to be drawn up through opening 18 and expelled rearwardly through nozzel 20. The water is drawn through duct 16 by an impeller assembly 18 connected by shaft 20 to an internal combustion engine or diesel engine 22. The engine is generally of the water cooled type having a conventional water jacket surrounding the cylinders. As is understood it is necessary to cool the engine water or other coolant.

Figure 4:
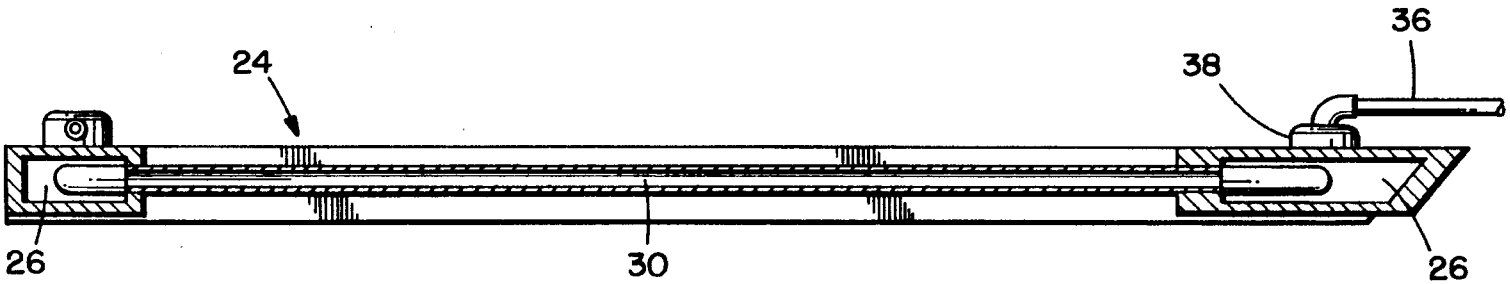
FIG. 4 is a sectional view taken on the line 4—4 of FIG. 3.

In order to prevent foreign objects such as stones, pieces of wood, shells, etc. from being conveyed through jet propulsion duct 16 there is provided a grating 24 positioned over the opening 18 in hull 10. The present invention is shown in detail in FIG. 3 and 4 to which reference is now made.

The grating has a forward reservoir 26 and a rear reservoir 28 which are joined by a series of open tubular members 30, thus the two reservoirs and tubes form a connected system through which a fluid such as the engine coolant may flow. Hose 32 connected to the engine water jacket connects to the rear reservoir as by connector 34 shown in FIG. 3. A return hose 36 similarly connects to the engine water jacket and to the forward reservoir 26 as by connector 38. In this manner the coolant water pump in the engine is able to pump the coolant through the grating network of tubes 30 reservoir 26 and reservoir 28.

Provision is made for cooling the engine oil by providing a tubular member 40 that maybe located in the center of the grating 24 and connected to the engine oil supply and oil pump by tubes 42 and 44.

It is seen then that as sea water from the body of water within which the watercraft is operating is drawn up through grating 24 by the impeller mechanism 18 to propel the watercraft forward. In doing so the sea water passing the grating will cool the engine coolant liquid as well as the engine oil supply. The grating then serves not only its purpose of screening out foreign objects from entering the propulsion system but is utilized as an engine cooling system.

Having thus described the invention with particular reference to the preferred forms thereof, i t will be obvious that various changes and modifications may be made therein without departing from the spirit and scope of the invention as defined in the appended claim.

What is claimed is:

1. A jet propelled watercraft comprising a hull;

an internal combustion engine mounted within said hull;

said engine having a water jacket for water cooling the engine;

a jet propulsion unit mounted within the hull including;

a water inlet opening passing through said hull through which water may be drawn from a body of water in which the watercraft is operating;

discharge nozzel means;

duct means connecting said inlet opening and said discharge nozzel;

impeller means within the duct means and connected to said internal combustion engine whereby water is drawn through the inlet opening and expelled out through the discharge nozzel to provide jet propulsion of the watercraft;

grating means positioned across said inlet opening to screen objects from entering said duct means;

said grating means having hollow tubular means; and tube means connecting said hollow tubular means to said engine water jacket.

2. The system set forth in claim 1 in which said hollow tubular means comprises a plurality of interconnected parallel tubes.

3. A jet propelled watercraft comprising a hull;

an engine mounted within said hull;

said engine having a liquid coolant jacket for cooling the engine;

a jet propulsion unit mounted within the hull including;

a water inlet opening passing through said hull through which water may be drawn from a body of water in which the watercraft is operating;

grating means positioned across said inlet opening to screen objects from entering said duct means;

said grating means having hollow tubular means; and tube means connecting said hollow tubular means to said engine water jacket.

4. A jet propelled watercraft comprising a hull;

an internal combustion engine mounted within said hull;

an oil lubricating system for said engine;

said engine having a water jacket for water cooling the engine;

a jet propulsion unit mounted within the hull including;

a water inlet opening passing through said hull through which water may be drawn from a body of water in which the watercraft is operating;

discharge nozzel means;

duct means connecting said inlet opening and said discharge nozzel;

impeller means within the duct means and connected to said internal combustion engine whereby water is drawn through the inlet opening and expelled out through the discharge nozzel to provide jet propulsion of the watercraft;

grating means positioned across said inlet opening to screen objects from entering said duct means;

said grating means having first hollow tubular means;

first tube means connecting said first hollow tubular means to said engine water jacket;

said grating means having second hollow tubular means isolated from said first hollow tubular means; and second tube means connecting said oil lubricating system to said second hollow tubular means whereby the engine oil and engine cooling water are cooled by water passing said grating means.

* * * * *